United States Patent [19]

Pacanowsky et al.

[11] Patent Number: 4,809,447

[45] Date of Patent: Mar. 7, 1989

[54] WATERPROOF BREATHABLE SOCK

[75] Inventors: David J. Pacanowsky, North East; Ruth S. Williams, Newark, both of Del.

[73] Assignee: W. L. Gore & Associates, INC., Newark, Del.

[21] Appl. No.: 120,331

[22] Filed: Nov. 13, 1987

[51] Int. Cl.[4] ..... A43B 1/02; A43B 1/04; A41B 11/00; A41D 17/00

[52] U.S. Cl. ..... 36/9 R; 36/2 R; 36/10; 36/84; 2/239; 428/253; 428/422

[58] Field of Search ..... 36/84, 9 R, 10, 2 R, 36/7.1 R, 45; 2/239, 240, 241, 243 A, DIG. 1, DIG. 5; 428/422, 247, 253

[56] References Cited

U.S. PATENT DOCUMENTS

| | | | |
|---|---|---|---|
| 2,343,477 | 3/1944 | Ross | 36/10 |
| 4,443,511 | 4/1984 | Worden et al. | 428/253 X |
| 4,550,446 | 11/1985 | Herman | 2/239 |

FOREIGN PATENT DOCUMENTS

| | | | |
|---|---|---|---|
| 3147202 | 6/1983 | Fed. Rep. of Germany | 36/7.1 R |
| 2539276 | 7/1984 | France | 36/2 R |

OTHER PUBLICATIONS

Letter from file wrapper of U.S. Pat. No. 4,550,446.

*Primary Examiner*—James Kee Chi
*Attorney, Agent, or Firm*—Mortenson & Uebler

[57] ABSTRACT

A multi-component, waterproof, sock-type article is provided comprising a waterproof, non-elastic, non-stretch sole component having a heel portion and a toe portion, a waterproof, non-elastic, non-stretch calf component, the calf component being attached to and forming a seam with the sole component at the heel portion, a vamp component attached to and forming seams with the sole and calf components, the vamp component comprising a waterproof, breathable, elastic, stretchable material having stretchability of more than 70%, the calf component being tapered inwardly proceeding upwardly from the heel portion of the sole component, all seams in the article being sealed with a waterproof material.

15 Claims, 1 Drawing Sheet

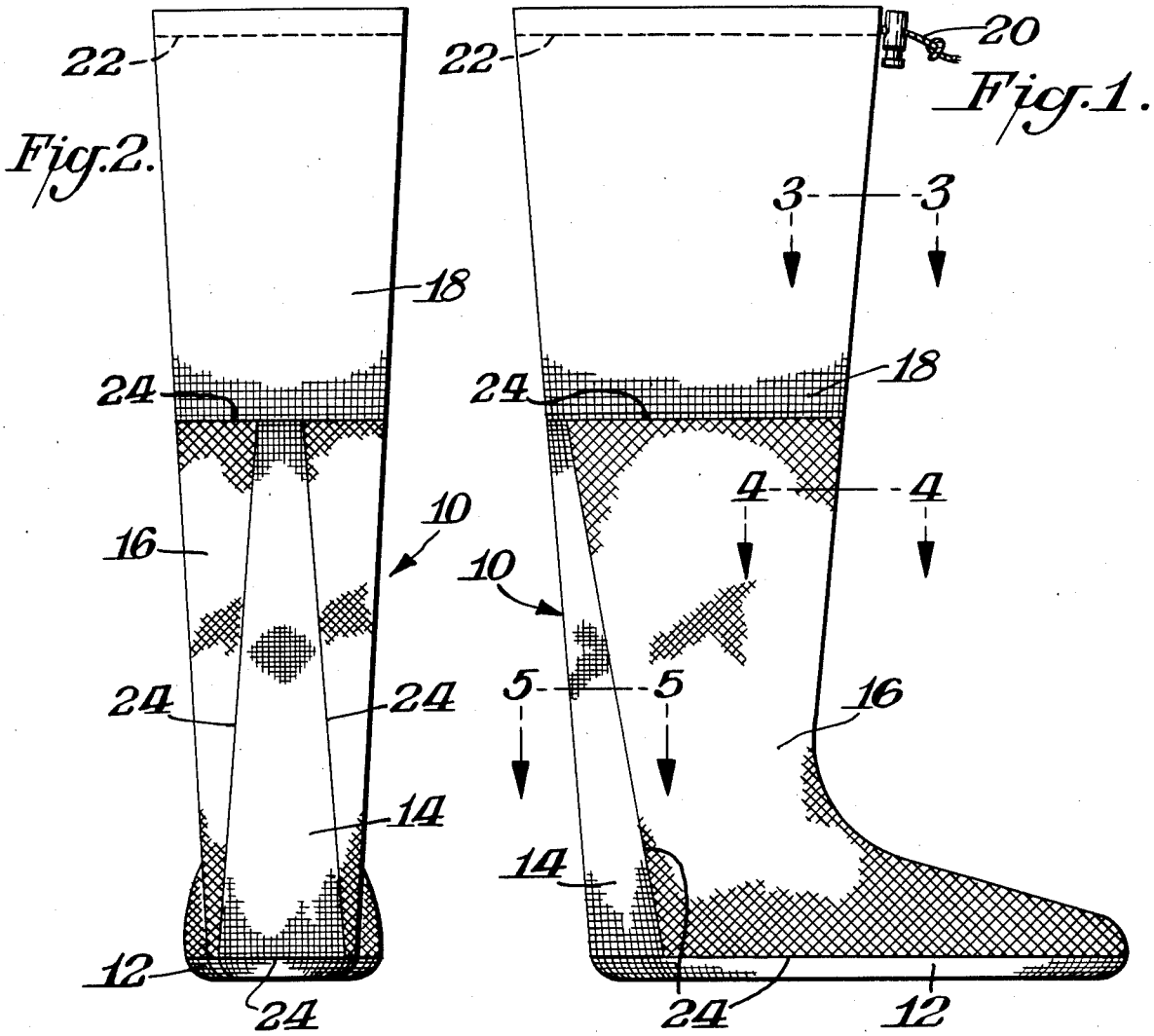
Fig. 3.
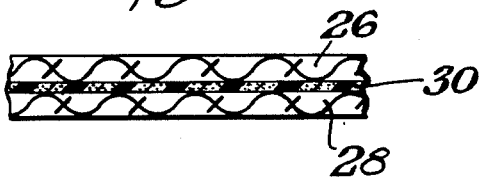
Fig. 4.
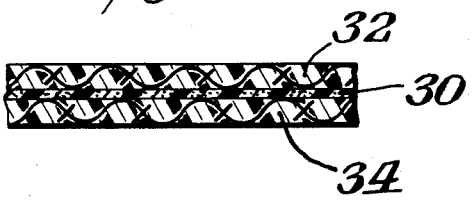
Fig. 5.
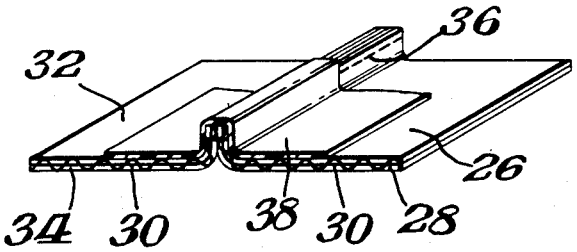

WATERPROOF BREATHABLE SOCK

BACKGROUND OF THE INVENTION

The present invention relates to improved articles of footwear particularly socks and inserts.

The problem of wet feet has plagued mankind since the dawn of history. Many attempts have been made to keep feet dry. The problem, however, is not as simple as just keeping the foot away from liquid water. This can be temporarily achieved by a variety of water impervious materials such as rubber boots. These forms of footwear are uncomfortable because, while they keep water from external sources away from the foot, they do not let perspiration escape. The result is that the foot becomes damp from perspiration. There was a need for a material that was both waterproof and breathable. U.S. Pat. No. 3,953,566 discloses a method of making a form of expanded polytetrafluoroethylene (PTFE) that possesses the contradictory properties of being both breathable and waterproof. U.S. Pat. No. 4,194,041 discloses an improvement on the material described in U.S. Pat. No. 3,953,566. The materials of both of these patents have been widely used in waterproof, breathable outdoor wear, including footwear, such as boots and socks.

While these materials were effective for their purpose, they had very little stretchability, generally less than 5%. This caused a problem in that, if the sock was designed to fit snugly when worn, it was very difficult to put on. If the sock was designed to be put on easily, it was too large when placed on the foot. U.S. Pat. No. 4,443,511 discloses a method of making stretchable, elastic, expanded PTFE material, thus providing a material that could be stretched up to 130%. Bunching is not normally a sock problem because a gentle pull smooths the fabric and the elastic recovery redistributes it over the heel and ankle. Conventional socks gradually abraid away, generally at the heel and toe, culminating in catastrophic failure. With the unique materials described in U.S. Pat. No. 4,443,511, the rubbing or buckling and tensioning of the material associated with bunching, typically under great pressure between the back stay, heel counter and topline of the footwear, prematurely induces holes and cracks in the membrane, greatly reducing the value of the product. Special donning and doffing instructions, followed carefully, can prevent this failure. A significant improvement is achieved by "rolling" the sock on. Socks and footwear have been made from this material, but they have proved not to be completely satisfactory because abrasion problems develop in the heel area. Above the heel, leaks can develop when a 100% stretch sock is put on improperly, i.e. stretched too much by not "rolling" the sock on.

SUMMARY OF THE INVENTION

A multi-component, waterproof, sock-type article is provided comprising a waterproof, non-elastic, non-stretch sole component having a heel portion and a toe portion, a waterproof, non-elastic, non-stretch calf component, the calf component being attached to and forming a seam with the sole component at the heel portion, a vamp component attached to and forming seams with the sole and calf components, the vamp component comprising a waterproof, breathable, elastic, stretchable material having stretchability of more than 70%, the calf component being tapered inwardly proceeding upwardly from the heel portion of the sole component, all seams in the article being sealed with a waterproof material. The sole, calf and vamp components are preferably laminates having a plurality of layers most preferably three-layer laminates. The inside layer of the three-layer laminate is preferably a knit material having a weight of less than about 2 oz./yd$^2$, the middle layer of the three-layer laminate is preferably a waterproof, breathable material such as waterproof, breathable, porous, expanded PTFE. The outer layer of the sole and calf laminate is preferably a woven fabric; the outer layer of the vamp is preferably a knit material. The article may have a waterproof, non-elastic, non-stretch gaiter component attached to and forming a seam with the upper portion of the article.

BRIEF DESCRIPTION OF THE DRAWINGS

FIG. 1 is a side elevational view of the sock according to the invention.

FIG. 2 is a rear elevational view of the sock according to the invention.

FIG. 3 is a cross-sectional view of the non-stretch laminate used in the invention taken along line 3—3 of FIG. 1.

FIG. 4 is a cross-sectional view of the stretchable laminate used in the invention taken along line 4—4 of FIG. 1.

FIG. 5 is a perspective view, partly in cross section, of a seam between stretchable and non-stretchable laminates according to the invention taken substantially along line 5—5 of FIG. 1.

DETAILED DESCRIPTION OF THE INVENTION AND PREFERRED EMBODIMENTS WITH REFERENCE TO THE DRAWINGS

A multi-component, waterproof, sock-type article is provided comprising a waterproof, non-elastic, non-stretch sole component having a heel portion and a toe portion, a waterproof, non-elastic, non-stretch calf component, the calf component being attached to and forming a seam with the sole component at the heel portion, a vamp component attached to and forming seams with the sole and calf components, the vamp component comprising a waterproof, breathable, elastic, stretchable material having stretchability of more than 70%, the calf component being tapered inwardly proceeding upwardly from the heel portion of the sole component, all seams in the article being sealed with a waterproof material.

Socks made partly of stretchable and elastic material and partly of non-stretch, non-elastic material are known. Generally the non-stretch, high-abrasion resistant material is employed in the sole, heel and calf portion of the sock, which are most vulnerable to abrasion and wear, and the elastic material is employed in the front vamp portion to provide ease of donning and doffing the sock.

The sock according to this invention provides the maximum amount of stretch material in the vamp portion of the sock, thereby providing a very easily donned and doffed sock, with little or no loss of abrasion resistance in areas subjected to excessive wear.

A detailed description of the invention and preferred embodiment is best provided with reference to the drawings wherein FIG. 1 shows the sock 10 of the invention in side elevation. Sock 10 is comprised of non-elastic, non-stretch sole 12 having a heel portion and a toe portion, a calf portion 14 of non-elastic, non-stretch material attached to the sole 12 at seam 24, and a vamp portion 16 of elastic, stretchable material attached to the sole 12 and calf portion 14 at seams 24. Optionally, a gaiter 18 of non-elastic, non-stretch material is attached to the upper opening of sock 10, being affixed thereto at seam 24. In the upper part of the gaiter, there may be draw string 20 held within stitching 22 for securing the top of the gaiter about the leg.

FIG. 2 shows a rear elevational view of the sock of the invention. Sock 10 comprises sole 12, calf portion 14, vamp 16 and gaiter 18, all attached together at seams 24.

A key to the invention lies in the fact that the calf portion 14 is tapered inwardly proceeding upwardly from the heel, as shown. In this construction, the very high wear heel area is still protected by the highlyabrasion resistant, non-stretch laminate according to the invention, and the center of the calf portion is also protected from excessive wear in donning the sock, while the area of the strectchable vamp portion is maximized for ease of donning and doffing the sock.

FIG. 3, taken along line 3—3 of FIG. 1, shows a preferred three-layer laminate of the non-stretch, non-elatic material used in the invention. Therein, outer layer 28 is preferably woven nylon, middle layer 30 is porous, expanded PTFE which may be stretchable as disclosed in U.S. Pat. No. 4,443,511, and inner layer 26 is preferably nylon tricot knit.

FIG. 4, taken along line 4—4 of FIG. 1, shows a preferred three-layer laminate of the stretchable elastic material used in the invention. Therein, outer layer 34 is preferably nylon stretch knit, middle layer 30 is stretchable, porous, expanded PTFE as disclosed in U.S. Pat. No. 4,443,511, and inner layer 32 is preferably nylon stretch knit.

FIG. 5 shows a sealed seam according to the invention taken along line 5—5 of FIG. 1. Therein, the stretchable laminate is shown stitched by thread 36 to the non-stretch laminate and the holes and gaps in the seam are sealed with tape 38. Tape 38 is preferably Gore-Seam TM tape available from W. L. Gore & Associates, Inc., Elkton, Md.

Application of the seam tape preferably begins on the sole of the sock, about one inch from the sole seam, and continues up the entire length of the front (shin) seam. The second seam tape application preferably beings on the sole of the sock, about one inch from the sole seam, and continues up the entire length of the heel-calf seam, and terminates on the seam which circles the leg at mid-calf, opposite the instep side for right socks, and on the instep side for left socks. The third seam tape application preferably beings on the sole of the sock, about one inch from the sole seam, and continues up the entire length of the outer heel-calf seam, and terminates on the seam which circles the leg at mid-calf, opposite the instep side for left socks, on the instep side for right socks. The fourth seam tape application preferably beings on the top of the seam tape, which covers the front (shin) seam at the intersecting mid-calf seam, and continues around the mid-calf seam until the starting point has been overlapped by about one inch. The final tape application preferably beings on top of the seam tape which covers the heel-calf seam on the instep side of the right sock, and opposite the instep side of the left sock and continues on around the sole seam until the starting point has been overlapped by about one inch. While it is not essential that the seam tape applications be done in the sequence described, there are advantages in following this procedure.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A multi-component, waterproof, sock-type article, comprising:

(a) a waterproof, non-elastic, non-stretch sole component having a heel portion and a toe portion;

(b) a waterproof, non-elastic, non-stretch calf component, said calf component being attached to and forming a seam with said sole component at said heel portion;

(c) a vamp component attached to and forming seams with said sole and calf components, said vamp component comprising a waterproof, breathable, elastic, stretchable material having stretchability of more than 70%;

(d) said calf component being tapered inwardly proceeding upwardly from said heel portion of said sole component; and (e) all seams in said article being sealed with a waterproof material.

2. The article of claim 1 in which each said sole, calf and vamp components are laminates having a plurality of layers.

3. The article of claim 2 in which each of said laminates are threelayer laminates.

4. The article of claim 3 in which the inside layer of said three-layer laminate is a knit material having a weight of less than about 2 oz./yd$^2$.

5. The article of claim 4 in which the middle layer of said threelayer laminate is a waterproof, breathable material.

6. The article of claim 5 in which said waterproof, breathable material is porous, expanded PTFE.

7. The article of claim 6 in which the porous, expanded PTFE has a microstructure of nodes interconnected by fibrils.

8. The article of claim 3 in which the outer layer of said laminate is a woven fabric.

9. The article of claim 1 in which said sole component is breathable.

10. The article of claim 1 in which said calf component is breathable.

11. The article of claim 8 in which said sole, calf and vamp component are breathable.

12. The article of claim 1 having a waterproof, non-elastic, nonstretch gaiter component attached to and forming a seam with the upper portion of said article.

13. The article of claim 12 wherein said gaiter component is a breathable laminate having a plurality of layers.

14. The article of claim 13 wherein said laminate is a three-layer laminate.

15. The article of claim 14 in which the outer layer of said laminate is a woven fabric.

* * * * *

UNITED STATES PATENT AND TRADEMARK OFFICE

CERTIFICATE OF CORRECTION

PATENT NO. : 4,809,447

DATED : March 7, 1989

INVENTOR(S) : David J. Pacanowsky and Ruth S. Williams

It is certified that error appears in the above-identified patent and that said Letters Patent is hereby corrected as shown below:

In the Heading:

At [75], please change "David J. Pacanowsky, North East; Ruth S. Williams, Newark, both of Del." to —David J. Pacanowsky, North East, Maryland; Ruth S. Williams, Newark, Del.—

In the Specification:

In col. 3, lines 17-18, please change "highlyabrasion" to —highly-abrasion—.

In col. 3, line 47, please change "beings" to —begins—.

In col. 3, line 53, please change "beings" to —begins—.

In col. 3, lines 58-59, please change "beings" to —begins—.

UNITED STATES PATENT AND TRADEMARK OFFICE

CERTIFICATE OF CORRECTION

PATENT NO. : 4,809,447

DATED : March 7, 1989

INVENTOR(S) : David J. Pacanowsky and Ruth S. Williams

It is certified that error appears in the above-identified patent and that said Letters Patent is hereby corrected as shown below:

In the Claims:

In claim 3, line 36, please change "threelayer" to —three-layer—.

In claim 5, line 41, please change "threelayer" to —three-layer—.

In claim 12, line 57, please change "nonstretch" to —non-stretch—.

Signed and Sealed this

Tenth Day of April, 1990

*Attest:*

*Attesting Officer*

HARRY F. MANBECK, JR.

*Commissioner of Patents and Trademarks*